US006249925B1

(12) United States Patent
Ishida et al.

(10) Patent No.: US 6,249,925 B1
(45) **Date of Patent: *Jun. 26, 2001**

(54) BRIDGE OF SHOCK-ABSORBING CONSTRUCTION

(75) Inventors: Hiromu Ishida; Yasushi Kamihigashi; Kenji Kubota; Tadashi Kanno, all of Machida; Sakashi Kamata, Ohtsu; Yujiro Matsuyama, Ohtsu; Yoshio Araki, Ohtsu; Kiyoshi Negishi, Ohtsu; Chisato Nonomura, Ohtsu, all of (JP)

(73) Assignees: Japan Highway Public Corporation, Tokyo-to; Toyo Boseki Kabushiki Kaisha, Osaka-fu, both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/103,111

(22) Filed: Jun. 23, 1998

(30) Foreign Application Priority Data

Jun. 30, 1997 (JP) ..... 9-174907
Jun. 30, 1997 (JP) ..... 9-174908

(51) Int. Cl.[7] ..... E01D 19/04
(52) U.S. Cl. ..... 14/73.5; 14/77.1; 14/78
(58) Field of Search ..... 52/167.7, 167.8, 52/393; 14/73.5, 74.5, 75, 78, 73, 77.1

(56) References Cited

U.S. PATENT DOCUMENTS

| | | | | |
|---|---|---|---|---|
| 194,580 | * | 8/1877 | Clark . | |
| 440,938 | * | 11/1890 | Anthoni . | |
| 3,130,819 | | 4/1964 | Marshall | 188/1 |
| 3,906,687 | * | 9/1975 | Schupack | 14/74.5 |
| 4,252,482 | * | 2/1981 | Naves | 14/73.5 |
| 4,959,934 | * | 10/1990 | Yamada et al. | 52/167.8 |
| 5,054,251 | * | 10/1991 | Kemeny | 14/73.5 |
| 5,065,555 | * | 11/1991 | Kobori et al. | 52/167.7 |
| 5,551,673 | * | 9/1996 | Furusawa et al. | 52/167.8 |
| 5,775,038 | * | 7/1998 | Sauvageot | 14/73.5 |
| 5,832,678 | * | 11/1998 | Nerwcomb et al. | 14/73.5 |
| 5,918,339 | * | 7/1999 | Marioni et al. | 14/73.5 |

FOREIGN PATENT DOCUMENTS

| | | |
|---|---|---|
| 1206981 | 7/1986 | (CA) . |
| 0 705 994 A2 | 4/1996 | (EP) . |
| 0 705 994 A3 | 2/1997 | (EP) . |
| 1084064 | 9/1967 | (GB) . |
| 2 305 487 | 4/1997 | (GB) . |

* cited by examiner

*Primary Examiner*—Eileen D. Lillis
*Assistant Examiner*—Raymond W. Addie
(74) *Attorney, Agent, or Firm*—Morrison & Foerster LLP

(57) ABSTRACT

A bridge of shock-absorbing construction is disclosed, which includes horizontal members arranged in series, vertical members supporting the horizontal members, and connectors for connecting the adjacent horizontal members or for connecting the horizontal member and the vertical member, wherein shock absorbers formed from a material with an elastic modulus in flexure over 200 kgf/cm$^2$ and each having a wall structure in a shock-loading direction are disposed on the connectors or at the points of contact between the horizontal members or between the horizontal member and the vertical member.

20 Claims, 10 Drawing Sheets

BRIDGE OF SHOCK-ABSORBING CONSTRUCTION

This application claims foreign priority from Japanese Patents # 174907/1997 filed Jun. 3, 1997 And # 174908/1997 filed Jun. 30, 1997.

FIELD OF INVENTION

The present invention relates to a bridge of novel shock-absorbing construction, and more particularly, to a bridge of shock-absorbing construction in which shock absorbers are disposed at the points of contact between the horizontal members or between the horizontal member and the vertical member and on the connectors for connecting the adjacent horizontal members or for connecting the horizontal member and the vertical member to ensure the effective absorption or attenuation of a shock.

BACKGROUND OF THE INVENTION

Most of the bridge failings caused by a shock such as an earthquake are due to the breakage or separation of members by the shock of collisions at the points of connection between the adjacent horizontal members or between the horizontal member and the vertical member in the bridge. This fact was confirmed in the Great Hanshin-Awaji Earthquake of 1995.

For the prevention of bridge failings, various methods have hitherto been adopted, including the formation of a slippage-preventive protrusion (i.e., bracket) or a bridge falling-preventive wall (i.e., safety wall) on the top of a vertical member or on the bottom of a horizontal member; the connection between the horizontal member and the vertical member by PC steel parts or anchor bars; and connection between the adjacent horizontal members by PC steel parts.

In the breakage or falling of bridges as previously investigated in the earthquake disasters of the past, there have been often found damage caused by vertical displacement to the bridge axis and damage probably caused by shock vibration. For this reason, most of the bridge falling-preventive construction now in practical use involves both connecting construction that can follow the vertical movement to the bridge axis and shock-absorbing construction with shock absorbers for absorbing or attenuating the shock vibration.

The shock absorber which has been used in the bridge of such shock-absorbing construction may include molded rubber parts characterized by good restitution. In the case where shock absorbers are disposed at very limited sites such as points of connection between the adjacent horizontal members or between the horizontal member and the vertical member, the use of molded rubber parts gives a limitation on the size of shock absorbers, leading to a deterioration in the shock-absorbing performance, which makes it difficult to obtain satisfactory effects on the prevention of breakage or falling of bridges against strong and shock vibration. The shock absorption may also be increased by the use of molded rubber parts made thicker or by the combined use of more than one molded rubber part, in which either case, however, the shock absorbers become large-sized, so that they are difficult to dispose at very limited sites, in addition to a steep rise in material costs and an increase in weight.

Some shock absorbers other than molded rubber parts have also been known, for example, metal springs, shock-attenuating friction members, and shock-attenuating hydraulic members. Metal springs, although they have excellent shock-absorbing performance, have an inevitable problem of rust formation; therefore, elaborate maintenance is needed after construction and, from a viewpoint of resistance to rust and weather, they are not suitable for use in the bridges to be constructed at locations exposed to salt water, such as coastal bridges and marine connecting bridges. In general, friction or hydraulic shock-attenuating members are structurally complicated and both much expensive and heavy, and they cannot keep their original performance without undergoing proper maintenance.

As the shock absorbers using molded resin parts, Japanese Patent Publication No. 61-12779/1986 discloses a technique for the improvement of shock-absorbing performance where hollow molded parts of a thermoplastic resin elastomer are provided with permanent strain by pre-compression in the axial direction. However, such molded resin parts, although they have improved ability to function as an elastic body, have poor performance of absorbing the energy of compression, so that they cannot be expected to have satisfactory shock-absorbing performance for use in the prevention of bridge falling caused by earthquakes or other factors.

The present inventors have developed a shock absorber formed from an elastic resin, comprising more than one arch-, dome-, or honeycomb-shaped member capable of causing deformation by compression, which are disposed on a perforated or non-perforated flat plate of an elastic resin, and thereby having cushioning properties; and they have proceeded with various studies to put such a shock absorber to practical use. This type of shock absorbers is suitable for some applications in which they are widely spread over the side wall of a road or the floor of a building to exhibit uniform cushioning performance over a wide area; however, they are difficult to adopt some applications in which they have to be disposed at limited sites such as points of connection between the adjacent horizontal members or between the horizontal member and the vertical member, and they cannot exhibit satisfactory shock-absorbing performance.

The shock absorbers in the bridge construction are often disposed in the vicinity of horizontal member-bearing portions on the vertical members; therefore, they should not become an obstacle to the maintenance works of the bearing portions, such as inspection, conservation, and repair. Therefore, they are required to be small-sized and lightweight, and have excellent shock-absorbing performance, i.e., higher absorption of energy of compression rather than reaction; however, the conventional shock absorbers as described above cannot meet these requirements.

SUMMARY OF THE INVENTION

Under these circumstances, the present inventors have intensively studied to develop a shock absorber for use in bridges, which is small-sized and lightweight, has a simple construction, and exhibits higher absorption of energy of compression rather than reaction, and wherein if it is formed from a material with excellent rust resistance, water resistance, and weather-ability, the bridge containing such shock absorbers can find various practical applications, including inland bridges, coastal bridges, and marine connecting bridges, even in which case the bridge is free of maintenance to retain excellent shock-absorbing performance for a long period of time. As a result, they have found that the use of such a shock absorber makes it possible to prevent, with high reliability, the breakage of horizontal members or vertical members, or the falling of the horizontal members from the vertical members, by a shock such as an earthquake, thereby completing the present invention.

Thus, the present invention provides a bridge of shock-absorbing construction, comprising horizontal members arranged in series, vertical members supporting the horizontal members, and connectors for connecting the adjacent horizontal members or for connecting the horizontal member and the vertical member, wherein shock absorbers formed from a material with an elastic modulus in flexure over 200 kgf/cm$^2$ and each having a wall structure in a shock-loading direction are disposed on the connectors or at the points of contact between the horizontal members or between the horizontal member and the vertical member. For the effective absorption of large energy by a shock, the shock absorber preferably causes buckling deformation or permanent deformation in the wall structure by compression when loaded with the shock.

For example, when shaken by an earthquake, a bridge of such construction can effectively absorb or attenuate the shock of collisions between the horizontal members or between the horizontal member and the vertical member to prevent these members from being damaged and further to prevent the horizontal member from falling from the vertical member.

BRIEF DESCRIPTION OF THE DRAWINGS

The above and still further objects, features, and advantages of the present invention will become apparent upon consideration of the following detailed description of the invention, especially when taken in conjunction with the accompanying drawings wherein like reference numerals in various figures are utilized to designate like portions, and wherein.

DETAILED DESCRIPTION OF THE INVENTION

Figure 1:
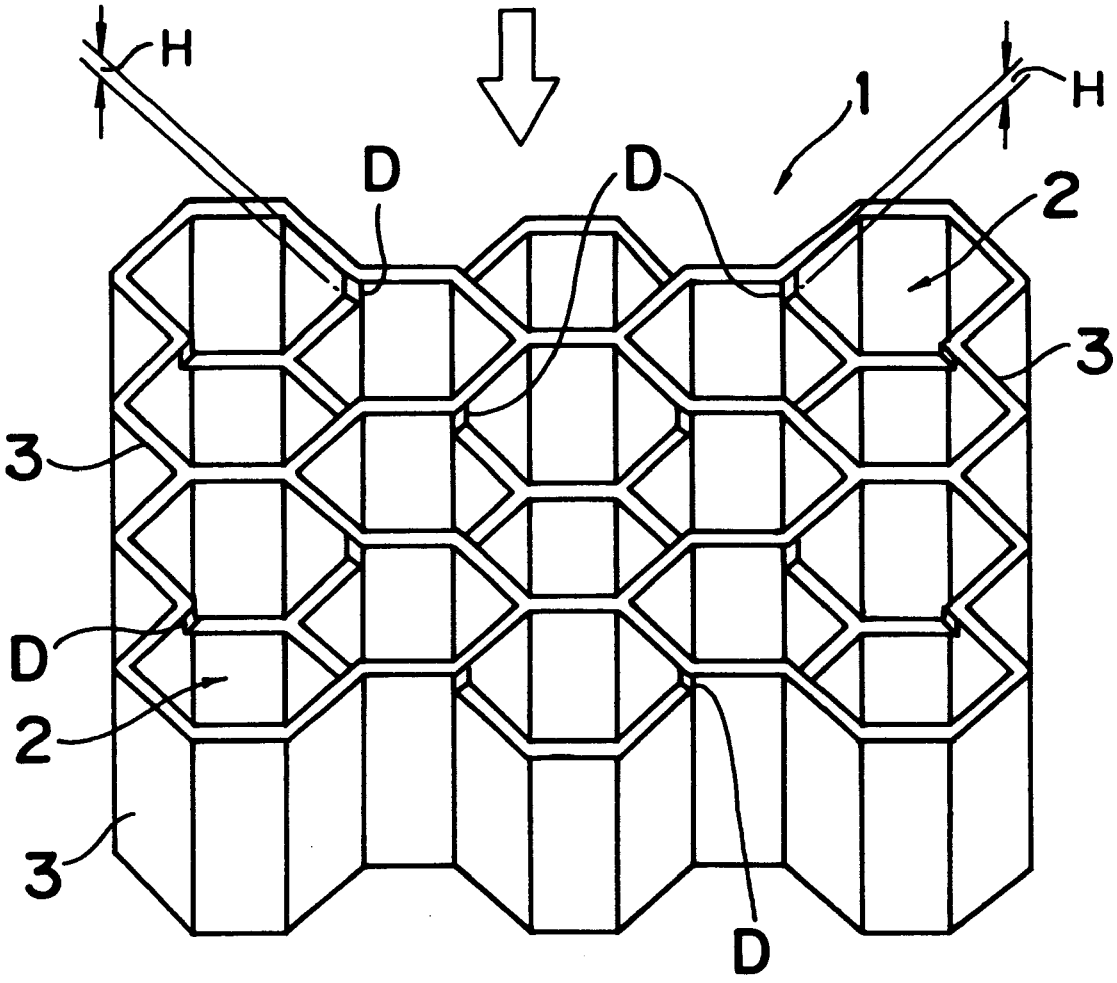
FIG. 1 is a perspective view showing a typical example of the shock absorber of the first type, which can be used in the bridge of shock-absorbing construction according to the present invention.

The bridge of shock-absorbing construction according to the present invention contains horizontal members arranged in series, vertical members supporting the horizontal members and each optionally having a safety wall, and connectors for connecting the adjacent horizontal members or for connecting the horizontal member and the vertical member, wherein shock absorbers are disposed on the connectors and at the points of contact between the horizontal members or between the horizontal member and the vertical member.

The use of particular shock absorbers in a bridge makes it possible to attain effective absorption or attenuation of a shock loaded on the points of contact between the constitutive members of the bridge, for example, by an earthquake, so that the protective portions of the bridge or the neighboring structures can be prevented from being damaged or broken by the shock, and accidental fallings of the horizontal members from the vertical members, i.e., bridge falling accidents, can be prevented from happening.

The shock absorber has to be formed from a material with an elastic modulus in flexure over 200 kgf/cm$^2$, preferably 500 kgf/cm$^2$, and has a wall structure in a shock-loading direction. The term "wall structure in a shock-loading direction" as used herein refers to a wall structure provided substantially parallel to a shock-loading direction. If a shock absorber is formed from a material with an elastic modulus in flexure lower than 200 kgf/cm$^2$, it has insufficient stiffness, so that it causes immediate elastic deformation when loaded with a shock. In other words, the shock absorber exhibits a decrease in the absorption of shock energy, so that it cannot sufficiently absorb the shock, making it impossible to obtain satisfactory cushioning effects. To solve this problem, a thicker wall structure in the shock-loading direction is needed for the shock absorber. As a result, a shock absorber should be made larger in size, which is not preferred with a departure from the purpose of the present invention.

It is important that the shock absorber causes buckling deformation or permanent deformation in the wall structure by compression when loaded with a shock, thereby attaining effective shock absorption. Therefore, a shock absorber is not preferred to have such a structure that absorbs a shock only by its elastic deformation. This is because when sudden large shocks, such as earthquakes, are loaded on the shock absorber with such a structure several times or some dozens of times for a short period of time, the shock absorber cannot have sufficient energy-absorbing performance or may sometimes cause a resonance phenomenon and rather increase the vibration of the horizontal members of a bridge, thereby quickening the breakage of the bridge structure.

The shapes of shock absorbers used in the bridge of shock-absorbing construction according to the present invention are roughly divided into the following two types.

One is a shock absorber having such a shape that can absorb a shock on the fairly large area thereof (hereinafter referred to as the shock absorber of the first type). The shock absorber of the first type is mainly disposed at the point of contact between the horizontal members or between the horizontal member and the vertical member. For the vertical member with a safety wall, the shock absorber of the first type may be disposed either on the safety wall or on the inner side wall of the horizontal member so that the inner side wall of the horizontal member is not brought into direct contact with the safety wall. The other is a shock absorber of relatively small size, which is mainly disposed on the connector for connecting the adjacent horizontal members or for connecting the horizontal member and the vertical member (hereinafter referred to as the shock absorber of the second type).

The shock absorber of the first type is characterized in that it has a multiple wall structure in a shock-loading direction. The shock absorber of the first type preferably has a cell structure in which a plurality of cells are joined together through at least a part of each cell wall along the shock-loading direction and isolated from each other in the shock-loading direction. The cells in the cell structure may be composed of penetrating holes open at both ends, concave cavities open only at one end, or hollow cavities closed at both ends.

When the shock absorber of the first type with such a cell structure is loaded with a shock, the wall structure in the shock-loading direction, which is composed of cell walls in the cell structure, causes buckling deformation to take an accordion shape, thereby attaining effective shock absorption.

To secure sufficient shock-absorbing performance that can cope with sudden shocks, for example, by earthquakes, the shock absorber of the first type can preferably absorb compression energy of 50 tf.m/m$^3$ or higher when compressed by these shocks in the shock-loading direction. This performance is achieved by the use of a resin with an elastic modulus in flexure ranging from 500 to 20,000 kgf/cm$^2$, preferably 500 to 20,000 kgf/cm$^2$, or more preferably 800 to 4000 kgf/cm$^2$, or by the use of a material with an elastic modulus in flexure over 5000 kgf/cm$^2$.

The shock absorber of the first type may be formed from any natural or synthetic elastic resin, so long as the resin meets the above condition on the elastic modulus in flexure. Specific examples of the resin preferably used are thermoplastic polyester elastomers, polyolefin elastomers, polyurethane elastomers, and polyamide elastomers, including their blends in any ratio, and thermosetting resins such as polyurethane resins for use in the casting. Particularly preferred are thermoplastic polyester elastomers and polyolefin elastomers because of their excellent weatherability and water resistance.

The shock absorber of the first type may also be formed from any material, so long as the material meets the above condition on the elastic modulus in flexure. The use of a material with excellent rust preventing properties and water resistance is preferred. Specific examples of such a material are thermoplastic resins and thermosetting resins; thermoplastic resins and thermosetting resins, each reinforced with fillers (e.g., carbon black, talc, glass beads), fibrous reinforcing materials (e.g., metal fibers, glass fibers, carbon fibers), or whiskers; and metals such as iron, aluminum, nickel, copper, titanium, zinc, tin, lead, aluminum alloys (e.g., duralumin), brass, and stainless steel. Particularly preferred metals are aluminum, copper, brass, duralumin, and stainless steel because of their excellent weatherability and water resistance.

In the case of the shock absorber of the first type, which is formed from such a resin or material, the rise of reaction at a time when the cells serving as escape spaces become smaller with the development of buckling deformation may sometimes become too steep. To solve this problem, the cells may be filled with other cushioning materials such as foamable resins or rubber.

The shock absorber of the first type can have further improved initial shock-absorbing performance by the adoption of a wall structure containing such a particular portion in the shock-loading direction that causes first deformation when loaded with a shock. In this case, the wall structure in the shock-loading direction may preferably be provided with a cutout portion, a stepped portion, or a thin-walled portion. When loaded with a shock, the shock absorber of the first type causes immediate deformation in such a particular portion, so that the initial shock-absorbing performance can be improved and the reaction to the shock can be further reduced.

For attaining efficient absorption of energy, the cell structure of the shock absorber preferably has a hexagonal or lower polygonal pattern in a section perpendicular to the shock-loading direction. More preferably, it is a honeycomb structure with a hexagonal pattern.

The shock absorber of the second type may have a plateau strength of 400 tf.m/m$^3$ or higher and absorbs compression energy of 200 tfm/m$^3$ or higher, and the shock absorber of the second type has a cylindrical wall structure in the shock-absorbing direction. To meet these conditions, the shock absorber of the second type is preferably formed from a resin with an elastic modulus in flexure ranging from 200 to 5000 kgf/cm$^2$, or a material with an elastic modulus in flexure over 5000 kgf/cm$^2$.

The shock absorber of the second type may preferably have at least one flange. In addition, the shock absorber of the second type may preferably have a cylindrical wall structure containing such a particular portion in the shock-loading direction that causes first deformation when loaded with a shock. In this case, the cylindrical wall structure in the shock-loading direction may preferably be provided with a cutout portion or a thin-walled portion, or have an accordion structure.

The shock absorber of the second type is mainly disposed at the end of a connector for connecting the adjacent horizontal members or for connecting the horizontal member and the vertical member. The connector preferably runs through the shock absorber of the second type. In addition, the connector is preferably a connection cable, i.e., cable-type connector.

The following will give a typical example of the shock absorber of the first type, which can be used in the bridge of shock-absorbing construction according to the present invention, and the mechanism of shock absorption will be explained in detail.

FIG. 1 is a perspective view showing a typical example of the shock absorber of the first type, i.e., a shock absorber with a honeycomb structure, which has been integrally formed from an elastic resin meeting the above condition on the elastic modulus in flexure. In this figure, shock absorber 1 has a cell structure that is composed of many penetrating holes 2, 2, . . . , at equal intervals, each having a hexagonal section and each running in the shock-loading direction shown by the thick arrow. When loaded with a shock, cell walls 3, 3, . . . , separating penetrating holes 2, 2, . . . , cause elastic deformation and further buckling deformation in the direction of penetrating holes, thereby attaining the effective absorption of the shock.

More particularly, the shock absorber of the first type as shown in FIG. 1 can absorb a shock by the inherent elasticity of cell walls 3, 3, . . . , formed from an elastic resin, and by buckling deformation with penetrating holes 2, 2, . . . , serving as escape spaces. In addition, a suitable stiffness is given to the shock absorber, particularly by cell walls 3, 3 . . . , extending in a honeycomb or lattice pattern when viewed in the shock-loading direction, with many penetrating holes 2, 2, . . . , running in the shock-loading direction as shown in FIG. 1. As a result, the shock absorber can have both shock-absorbing effects by the above elastic deformation and suitable stiffness, on the whole, so that the shocks of strong vibrations caused by earthquakes or other factors can effectively be absorbed or attenuated. Furthermore, the shock absorber of the first type can be provided with a plurality of steps D at the ends, in the holes-running direction, of cell walls 3, 3, . . . , separating penetrating holes 2, 2, . . . , and the adjustment of height H and number of steps D, depending upon the degree of a possible shock, can improve the initial shock-absorbing performance and can further reduce the reaction to the shock.

The satisfactory shock-absorbing performance as a shock absorber can preferably be attained by the absorption of compression energy adjusted to 50 tf.m/m$^3$ or higher, more preferably 100 tf.m/m$^3$ or higher, as determined by a load (reaction) vs. compressibility curve, which is obtained for example, when the shock absorber of the first type as shown in FIG. 1 is compressed in the holes-running direction (i.e., in the direction of the thick arrow shown in this figure).

Figure 8:
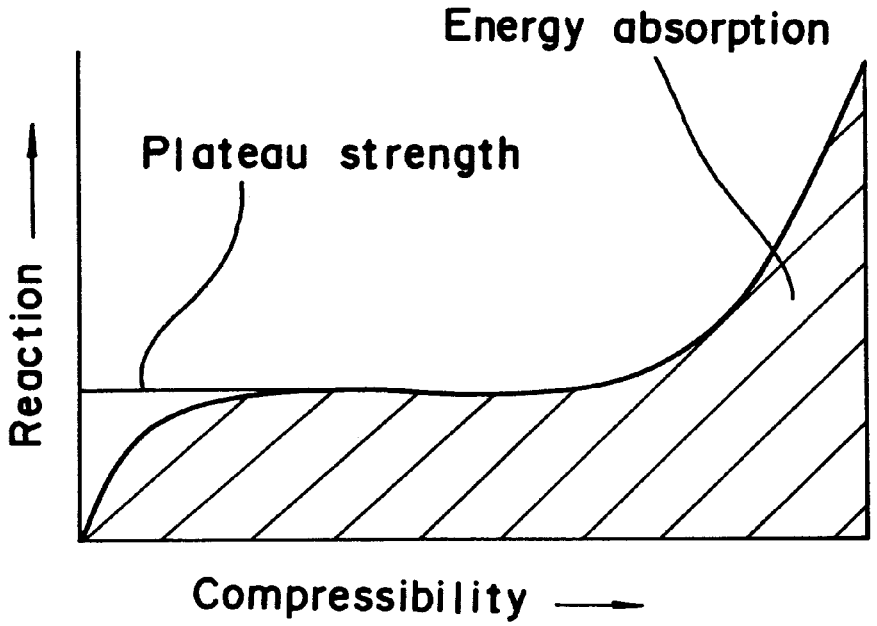
FIG. 8 is a graph showing a typical example of the load (reaction) vs. compressibility curve of a shock absorber which can be used in the bridge of shock-absorbing construction according to the present invention.

The term "load (reaction) vs. compressibility curve" as used herein refers to a curve showing the correlation between load (reaction) observed in the compression of a shock absorber and compressibility. For example, as shown in FIG. 8, the load (reaction) vs. compressibility curve steeply rises in proportion to compressibility at the initial stage of compression. After that, the slope of the curve gradually becomes gentle and the load (reaction) becomes substantially constant with a rise in compressibility; therefore, the curve reaches a plateau point showing the maximum value of reaction in a limited portion. When the shock absorber is further compressed, cell walls 3, 3, . . . , cause buckling deformation with penetrating holes 2, 2, . . . , serving as escape spaces, and the reaction is kept on the substantially constant level during the development of the buckling deformation of cell walls 3, 3, . . . , and the curve steeply rises again with a reduction in the size of penetrating holes 2, 2, . . . , serving as escape spaces.

The term "plateau strength" as used herein refers to the quotient obtained by dividing the maximum value of reaction at the plateau portion after the initial rise in the curve as shown in FIG. 8 by the shock-receiving area of the shock absorber. The term "absorption of compression energy" as used herein refers to the quotient obtained by dividing the energy absorption, which is represented by the area under the curve as shown in FIG. 8 up to the compressibility of 80% (i.e., hatched area in this figure), by the volume of the shock absorber. The plateau strength does not always correspond to the maximum value of stress; however, it is a value closely corresponding to the maximum stress applied to the colliding body when the shock absorber is loaded with a shock, and it serves as the standard for the maximum value of stress.

The shock absorber of the first type preferably has a plateau strength in the range of 50 tf/m$^2$ to 5000 tf/m$^2$, more preferably 100 tf/m$^2$ to 2000 tf/m$^2$.

The shortage of plateau strength fails to give satisfactory exhibition of functions as a shock energy absorber. On the contrary, if the plateau strength is too high, larger reaction is generated at the shock loading, and there arises some fear that the breakage of horizontal members, vertical members, or neighboring structures, or the bridge falling, may be caused by the reaction. Therefore, for the purpose of attaining the effective absorption of shock energy to attain cushioning effects, it is effective to make the initial rise in the load (reaction) vs. compressibility curve as steep as possible, to make the reduction in reaction after the plateau point as small as possible, and to keep the reaction at a substantially constant level, which is lower than the force breaking the neighboring or surrounding structures, up to high compressibility. In other words, larger shock energy can be absorbed, if the hatched portion under the curve as shown in FIG. 8 takes a trapezoidal shape with a wider area.

Figure 9:
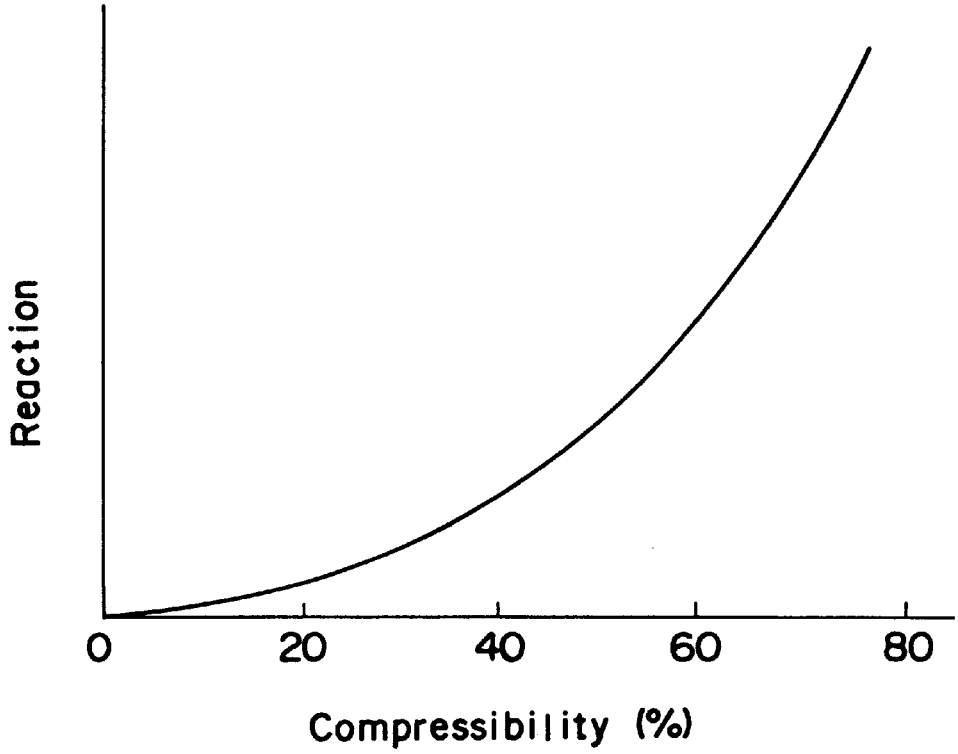
FIG. 9 is a graph showing the load (reaction) vs. compressibility curve of conventional rubber molded parts.

In view of this point, various studies have been made on the physical properties needed for the shock absorber of the first type, which can be used in the bridge of shock-absorbing construction according to the present invention. As a result, it has been confirmed that for the sufficient absorption of a shock and hence the effective prevention of horizontal members or vertical members from being damaged or broken, as described above, the absorption of compression energy should preferably be adjusted to 50 tf.m/m$^2$ or higher, more preferably 100 tf.m/m$^3$ or higher. In the meantime conventional shock absorbers such as molded rubber parts exhibit a gentle slope for the initial rise as shown in the load (reaction) vs. compressibility curve of FIG. 9, so that the satisfactory absorption of shock energy can be attained only by the use of a material in quantity, which is not preferred because of a increase both in size and in weight as the shock absorber of the first type.

Figure 10:
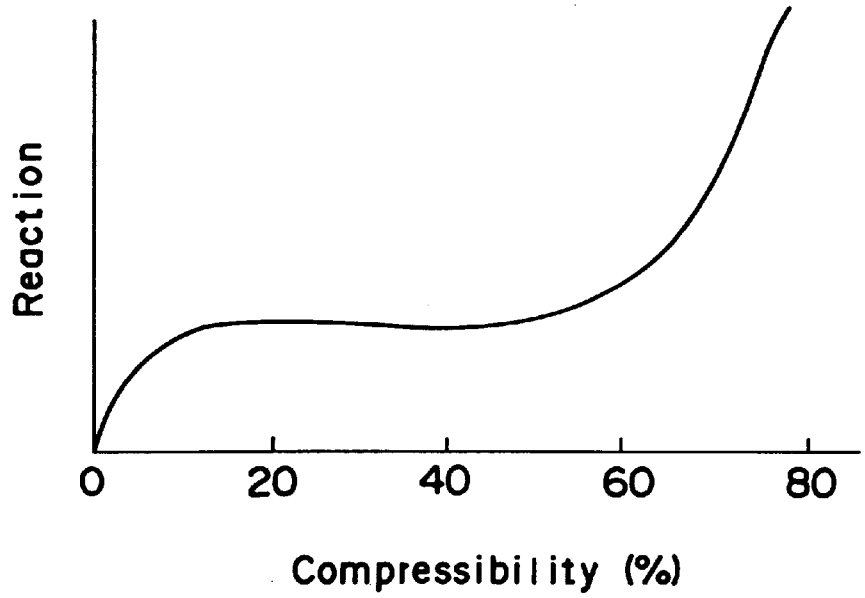
FIG. 10 is a graph showing the load (reaction) vs. compressibility curve of a shock absorber which can be used in the bridge of shock-absorbing construction according to the present invention.
Figure 11:
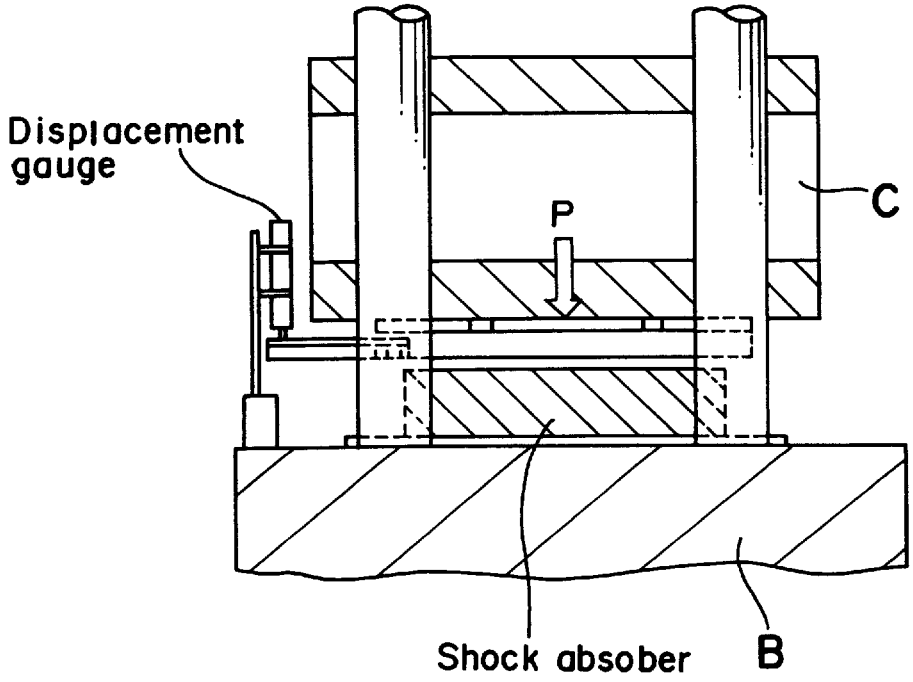
FIG. 11 is a fragmentary schematic view showing a static compression test machine used in the working examples and comparative examples as described below.

On the other hand, the shock absorber of the first type, which can be used in the bridge of shock-absorbing construction according to the present invention, exhibits a steep slope for the initial rise in the load (reaction) vs. compressibility curve and then a suitable plateau strength, for example, as shown in FIG. 10, after which it keeps the substantially constant level of reaction for some time with a rise in compressibility and then exhibits again a steep slope for the last rise in the load (reaction) vs. compressibility curve. As a result, in combination with the inherent elastic modulus in flexure of a material, the shock absorber of the first type can absorb compression energy in an extremely large amount of 50 tf.m/m$^3$ or higher.

The preferred kinds of resins, which can be used for the production of shock absorbers of the first type, are as described above, and these resins may be modified, if necessary, by the addition of various stabilizers such as antioxidants, ultraviolet light absorbers, and heat stabilizers; fillers such as dyes, pigments, carbon black, talc, and glass beads; reinforcing materials such as metal fibers, glass fibers, carbon fibers, and whiskers; and additives such as antistatic agents, plasticizers, flame retarders, foaming agents, and release agents in their appropriate amounts.

Figure 2A:
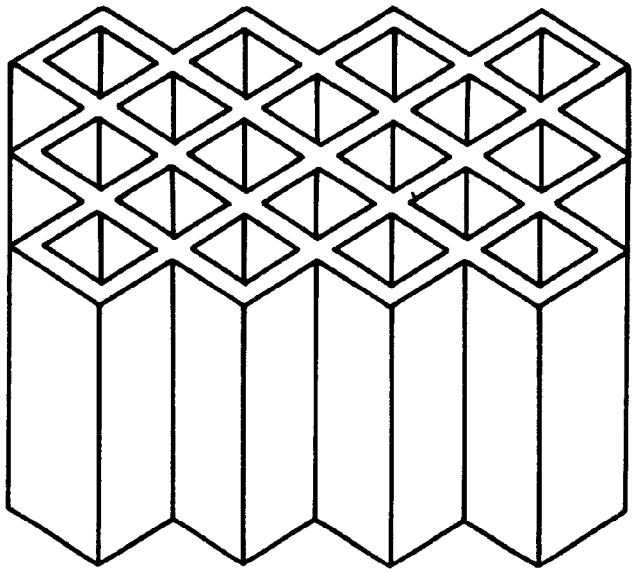
FIGS. 2A and 2B are perspective views showing different examples of the shock absorber of the first type, which can be used in the bridge of shock-absorbing construction according to the present invention.
Figure 2B:
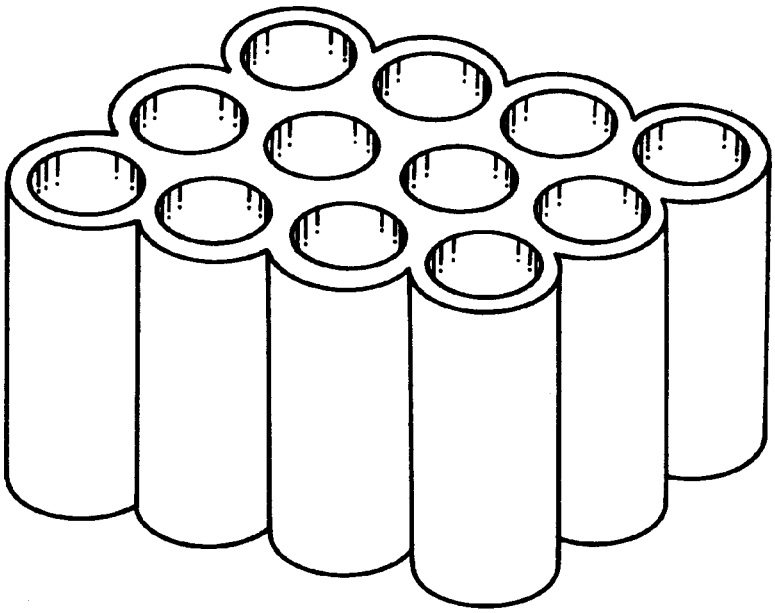

The shock absorber of the first type, which can be used in the bridge of shock-absorbing construction according to the present invention, is not limited to the specific structure as shown in FIG. 1, but it may be formed into any other structure, for example, in a lattice pattern composed of many penetrating holes rectangular or rhombic in section, or in a multi-tubular pattern composed of many penetrating holes circular or elliptic in section, as shown in FIGS. 2A and 2B, or in a further different pattern composed of many penetrating holes having a different shape in section. The size of the shock absorber of the first type may be determined suitably for the purpose of use, i.e., taking into account the gap at the shock-absorbing site and the degree of a possible shock. There is no limitation on the formation of shock absorbers of the first type, which may be achieved by any method, including injection molding, extrusion, or press molding.

Figure 3A:
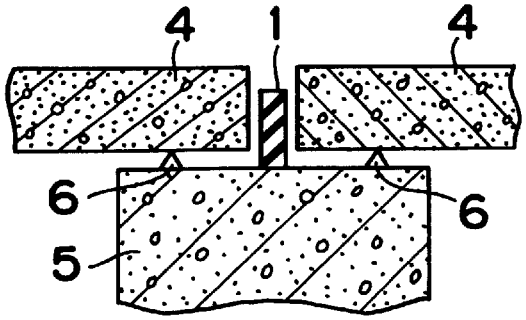
FIGS. 3A through 3G are sectional fragmentary schematic views showing various shock absorbers of the first type, which are disposed at the points of contact between the horizontal members or between the horizontal member and the vertical member in the bridge of shock-absorbing construction according to the present invention.
Figure 3B:
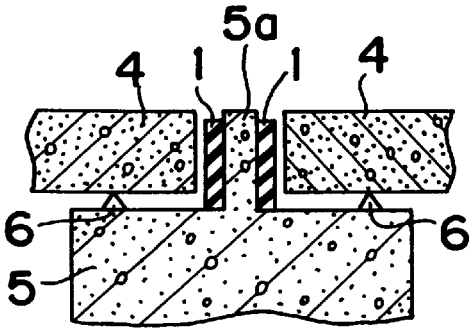
Figure 3C:
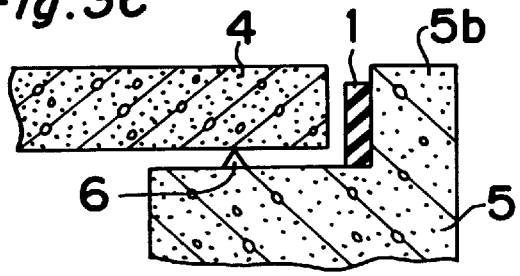
Figure 3D:
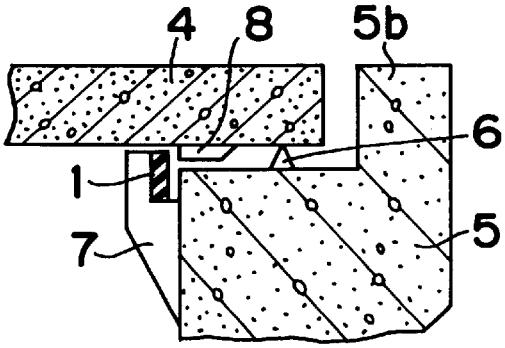
Figure 3E:
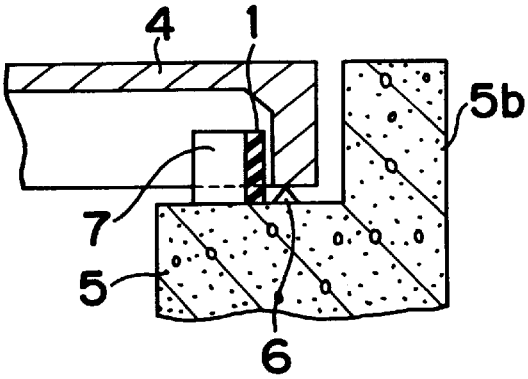
Figure 3F:
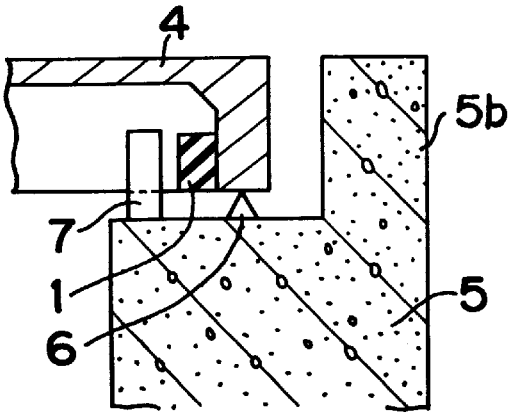
Figure 3G:
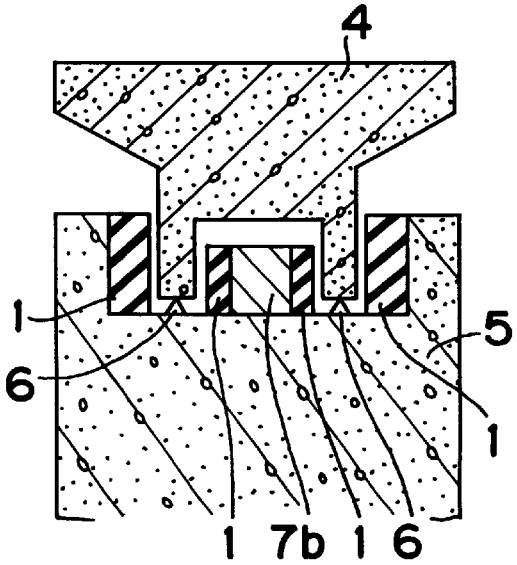

FIGS. 3A through 3G show different shock absorbers of the first type, which are disposed at the points of contact between the horizontal members or between the horizontal member and the vertical member in the bridge of shock-absorbing construction according to the present invention. In FIG. 3A, shock absorber 1 is attached to the top of vertical member 5 and interposed between the horizontal members 4, 4, which are flush with each other and supported, respectively, by bearing means 6, 6 on the vertical member 5. In FIG. 3B, shock absorbers 1, 1 are each attached to the respective sides of ridge-shaped protrusion 5*a* on the top of vertical member 5 and interposed between the horizontal members 4, 4, which are flush with each other and supported, respectively, by bearing means 6, 6 on the vertical member 5. In FIG. 3C, shock absorber 1 is attached to the side wall of L-shaped protrusion 5*b* on the top of vertical member 5 and interposed between the protrusion 5*b* and the horizontal member 4, which is supported by bearing mean 6 on the vertical member 5. In FIG. 3D, bracket 8 is formed on the bottom of horizontal member 4, which is supported by bearing means 6 on the vertical member 5 and faced to the side wall of L-shaped protrusion 5*b* on the top of the vertical member 5, safety wall 7 is formed on the side wall of the vertical member 5, and shock absorber 1 is attached to the safety wall 7 at the point of contact between the safety wall 7 and the bracket 8. In FIG. 3E, safety wall 7 is formed on the top of vertical member 5, and shock absorber 1 is attached to the safety wall 7 at the point of contact between the safety wall 7 and the inner side wall of bottom-hollowed horizontal member 4, which is supported by bearing means 6 on the vertical member 5 and faced to the side wall of L-shaped protrusion 5*b* on the top of the vertical member 5. In FIG. 3F, safety wall 7 is formed on the top of vertical member 5, and shock absorber 1 is attached to the inner side wall of bottom-hollowed horizontal member 4 at the point of contact between the safety wall 7 and the inner side wall of the bottom-hollowed horizontal member 4, which is supported by bearing means 6 on the vertical member 5 and faced to the side wall of L-shaped protrusion 5*b* on the top of the vertical member 5. In FIG. 3G, shock absorbers 1, 1, . . . , are each attached to the respective safety walls 7*b*, 7*b*, . . . , which are formed, respectively, at both edges and at the center so as to produce two parallel grooves on the top of vertical member 5, and horizontal member 4 having a reverse U-shaped portion on the bottom is supported by bearing means 6, 6 on the vertical member 5 so that the reverse U-shaped portion is fitted into the two parallel grooves and shock absorption in the transverse direction can be achieved.

In this way, the shock absorbers of the first type, having the physical properties and structure as described above, which have been disposed in a bridge at the points of contact between the horizontal members, between the horizontal member and the vertical member, or between the vertical member with a safety wall and the horizontal member, can attain effective absorption or attenuation of a shock when the bridge is shaken by earthquakes or other factors, to prevent the horizontal members, the vertical members, or the neighboring structures, from being damaged or broken by the shock, or to prevent bridge falling from happening by a drop of the horizontal members. It is to be understood that the connection between the horizontal member and the vertical member, and the positions of the shock absorbers attached, as shown in FIGS. 3A through 3G are only typical examples, and the present invention is not particularly limited to these examples. In addition, there is no limitation on the attachment of a shock absorber, and a suitable method may be adopted, for example, fastening with a bolt to an embedded nut, or fixing with an appropriate fitting means.

The following gives a detailed explanation of the shock absorber of the second type, which can be used in the bridge of shock-absorbing construction according to the present invention.

The shock absorber of the second type is disposed on the connector for connecting the adjacent horizontal members or for connecting the horizontal member and the vertical member. The connector may be in the form of a cable- or reinforcing bar-shaped metal rod, a metal plate, or the like. The shock absorbers of the second type may be disposed at both ends of such a connector so as to come in direct contact with the horizontal member or the vertical member.

The shock absorber of the second type may preferably have a plateau strength of 400 $tf/m^2$ or higher, but more preferably up to 20,000 $tf/m^2$, still more preferably 1000 to 10,000 $tf/m^2$, and may absorb compression energy of 200 $tf \cdot m/m^3$ or higher. The shock absorber of the second type may preferably have a cylindrical wall structure in the shock-absorbing direction. To meet these conditions, the shock absorber of the second type is preferably formed from a resin with an elastic modulus in flexure ranging from 200 to 5000 $kgf/cm^2$, more preferably 400 to 5000 $kgf/cm^2$, and still more preferably 700 to 4000 $kgf/cm^2$, or a material with an elastic modulus in flexure over 5000 $kgf/cm^2$. Examples of such a resin or material are the same as described for the shock absorber of the first type.

The shortage of plateau strength fails to give satisfactory exhibition of functions as a shock energy absorber. On the contrary, if the plateau strength is too high, larger reaction is generated at the shock loading, and there arises some fear that the breakage of horizontal members, vertical members, or neighboring structures, or the bridge falling, may be caused by the reaction.

The shock absorber of the second type may preferably have at least one flange because it can be loaded with a shock uniformly on the whole and deformation in the cylindrical shape at a suitable site can attain stable and efficient shock absorption.

The shock absorber of the second type may further preferably have a cylindrical wall structure containing such a particular portion in the shock-loading direction that causes first deformation when loaded with a shock. In this case, the cylindrical wall structure in the shock-loading direction may preferably be provided with a cutout portion or a thin-walled portion, or have an accordion structure.

The shock absorber of the second type, formed into such a cylindrical shape, is disposed at the end of a connector used at the point of connection between the adjacent horizontal members or between the horizontal member and the vertical member in a bridge. More particularly, the connector is inserted into the axial hollow portion of the cylindrical shock absorber of the second type, which is then fixed with an end fitting means at the end of the connector. The cylindrical shock absorbers of the second type may be each fixed at the respective ends of the connector. When the connector is loaded with a shock, the shock absorber of the second type causes buckling deformation to exhibit a function of absorbing the shock and attenuating a stress on the connector.

In this case, the end fitting portion of the connector may preferably be fixed with a bolt and a nut so that even if the shock to be attenuated by the shock absorber is loaded on the end-fitting portion there is no fear that the connector may be released or broken.

The shock absorber of the second type may be formed into any shape, so long as it is cylindrical with an axial hollow portion (i.e., hole) into which a connector can be inserted, as illustrated below in some drawings, and it gives a load (reaction) vs. compressibility curve, as shown in FIG. 8, when loaded with a compressive force. The cylindrical shape may be circular, polygonal, e.g., hexagonal, or any other different shape in section. Furthermore, there is no limitation on the shape of an axial hollow portion.

The shock absorber of the second type may also be formed from a resin with an elastic modulus in flexure within a specific range as described above, preferably an elastomer. There is no limitation on the formation of shock absorbers of the second type, which may be achieved by any method, including injection molding, compression molding, or extrusion. In some cases, a solid rod may be formed and then processed into a cylindrical shape by cutting or drilling.

Figure 4:
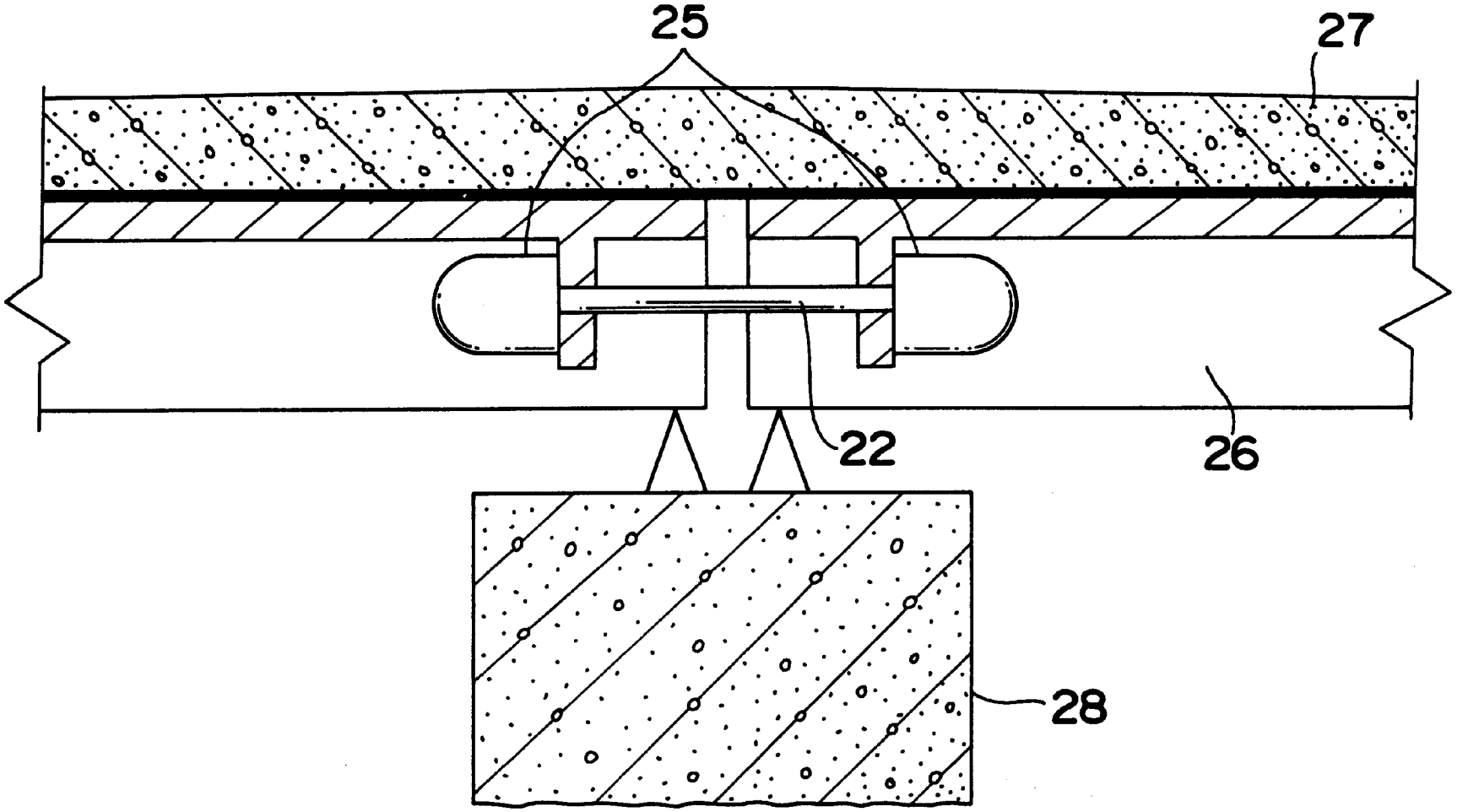
FIGS. 4 and 5 are sectional fragmentary schematic views showing the cable-type connectors for connecting the adjacent horizontal members and for connecting the horizontal member and the vertical member, respectively, in the bridge of shock-absorbing construction according to the present invention.
Figure 5:
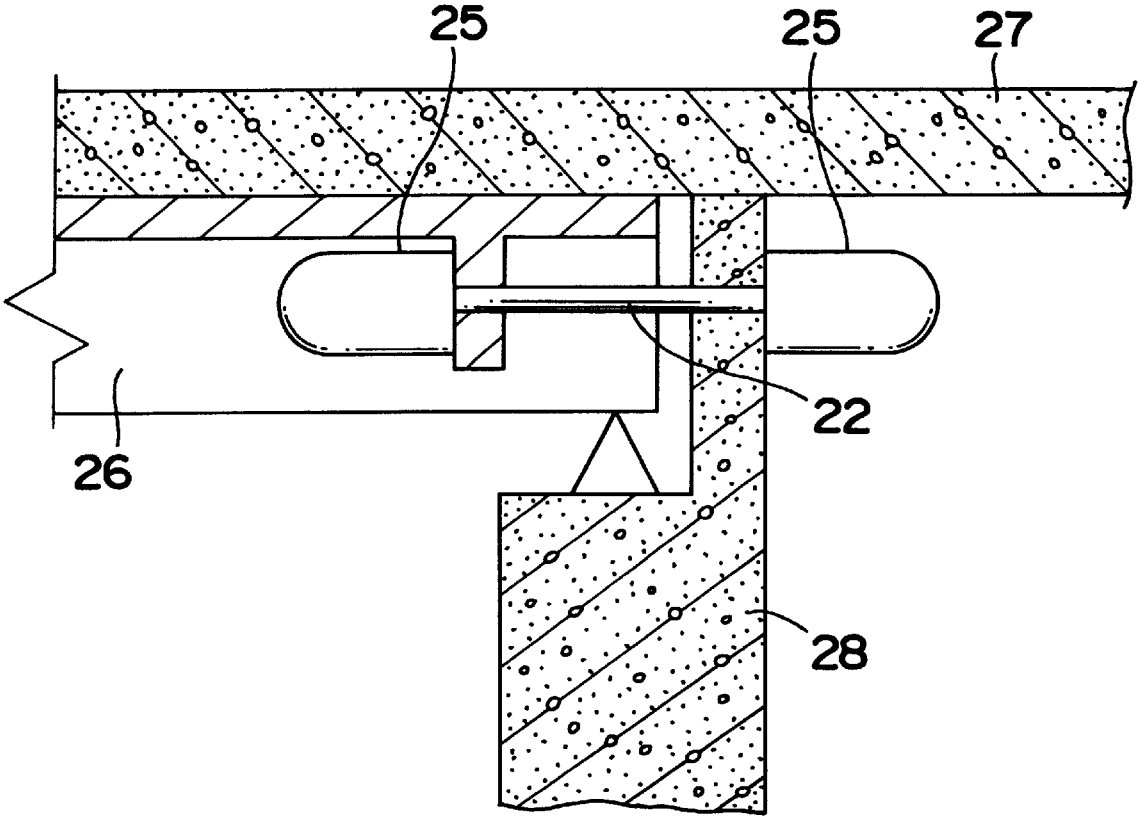
Figure 6:
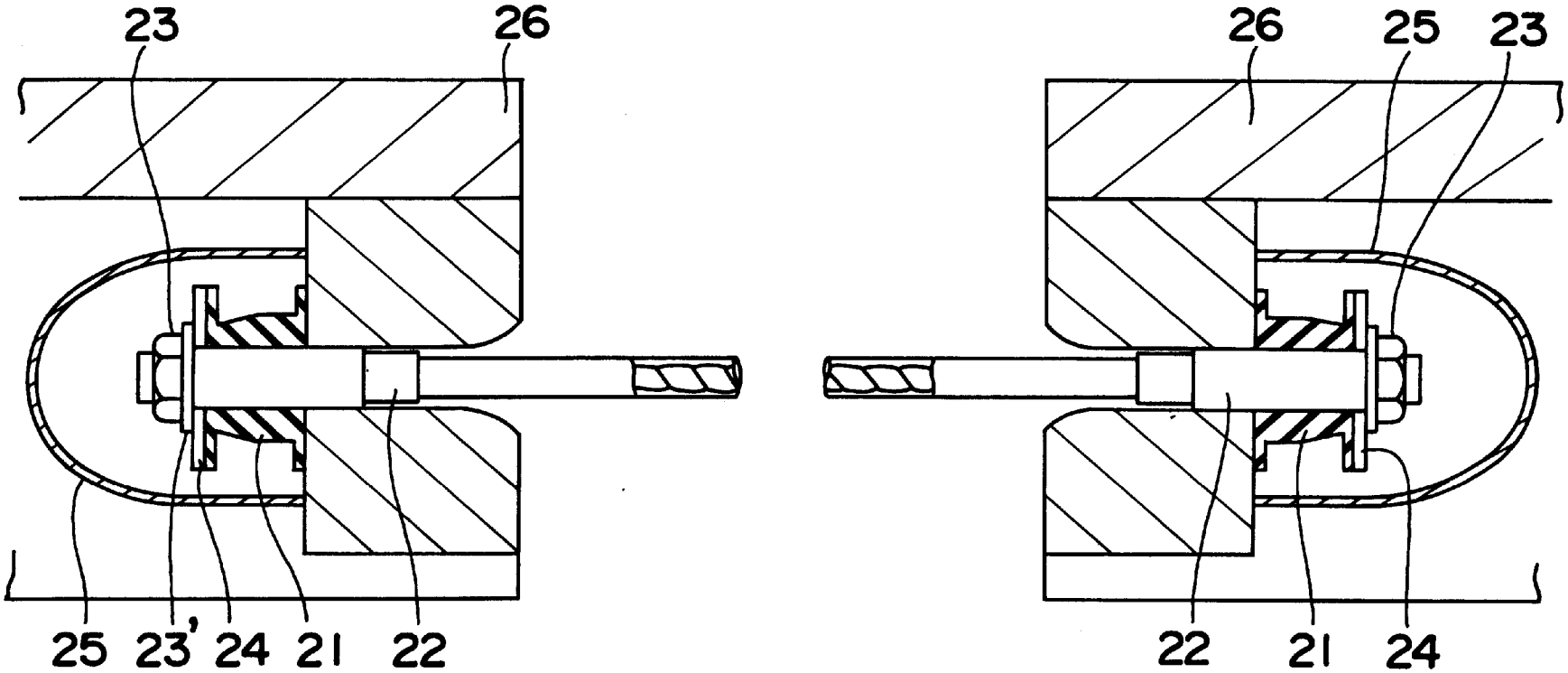
FIG. 6 is a sectional fragmentary schematic view showing a typical example of the shock absorbers of the second type, which are disposed at the ends of a cable-type connector for connecting the adjacent horizontal members in the bridge of shock-absorbing construction according to the present invention.

FIGS. 4 and 5 show the points of connection between the adjacent horizontal members and between the horizontal member and the vertical member, respectively, in the bridge of shock-absorbing construction according to the present invention. FIG. 6 shows a cable-type connector for connecting the adjacent horizontal members, on which the shock absorbers of the second type are each disposed at the respective ends.

The bridge of shock-absorbing construction according to the present invention contains, for example, as shown in FIG. 4, road 27 and a series of horizontal members 26, 26, which are supported, respectively, by bearing means on the vertical member 28 disposed on the top of bridge footing. In FIG. 4, horizontal members 26, 26 are connected with each other by cable-type connector 22 so as not to come off and fall from the vertical member 28. In FIG. 5, horizontal member 26 is supported by bearing means on the vertical member 28 and connected, for the prevention of its fall, by cable-type connector 22 with an L-shaped protrusion formed on the top of vertical member 28 so as to reach road 27.

The shock absorbers of the second type are disposed, for example, as shown in FIG. 6, for the absorption of a shock loaded on the cable-type connectors 22, 22 as shown in FIGS. 4 and 5, to prevent these connectors and surrounding structures from being damaged or broken. More particularly, cable-type connector 22 is inserted into the penetrating holes at the facing ends of the horizontal members 26, 26 (or the horizontal member 26 and vertical member 28 as shown in FIG. 5), and the ends of the cable-type connector 22 are each inserted into the respective axial hollow portions of cylindrical shock absorbers 21, 21 and fitted outside with support plats 24, 24, which are further fitted outside with washers 23', 23' and fastened with nuts 23, 23.

The cable-type connectors 22, 22, although they are fastened tight in FIG. 6, may be fitted loosely to such an extent that they can follow the slight motion of structures by temperature variation or vibration. Alternatively, elastic parts such as springs may be inserted between the support plate 24 and the nut 23 so that the cable-type connectors 22, 22 can follow the expansion and contraction of structures by temperature variation, or buffering parts other than springs may also be inserted. Furthermore, depending upon the thickness or width of the horizontal member 26, more than one cable-type connectors 22 may be disposed parallel with each other in the vertical or transverse direction, or may also be connected in series and disposed along the bridge. There is no limitation on their arrangement.

The size or configuration of the axial hollow portion (i.e., hole) to be formed in the shock absorber 21 is not particularly limited, so long as connector 22 can be inserted thereinto. If there is too large a gap between the shock absorber 21 and the connector 22 in the axial hollow portion, also effective is the insertion of a sleeve or other auxiliary means to reduce the gap. Furthermore, the fastening portion including shock absorber 21 and bolt 23 is preferably covered with protective cover 25, as shown in FIG. 6, to improve the durability and weatherability of the bridge and not to spoil the total appearance of the bridge.

The shock-absorbing construction according to the present invention has been explained with typical examples each using the shock absorber of the first or second type; however, the present invention is not limited to these examples. In addition, the shock absorber of the first type may be disposed on the connector for connecting the adjacent horizontal members, or the shock absorber of the second type may be disposed at the points of contact between the horizontal members or between the horizontal member and the vertical member.

EXAMPLES

The present invention will be further illustrated by the following working examples and comparative examples; however, it is, of course, to be understood that the present invention is not limited to these examples and any other variations, modifications, and changes fall within the scope of the present invention as defined by the appended claims.

It is substantially impossible to examine the performance of shock absorbers by disposing them at the points of contact between the horizontal members or between the horizontal member and the vertical member and then actually shaking the horizontal members. In the following working examples and comparative examples, therefore, experiments were performed by the simulation of such conditions. The determination of physical properties and the compression test both adopted in the experiments were carried out by the following procedures.

Elastic Modulus in Flexure

This was determined according to the widely adopted procedures of ASTM-D790.

Collisional Compression Test

Figure 12:
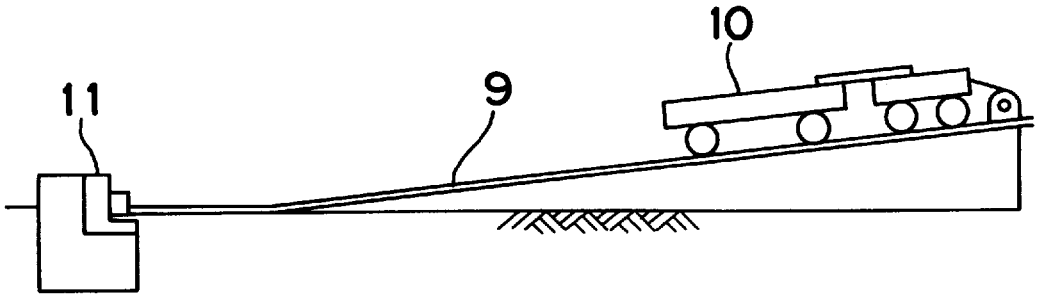
FIG. 12 is a schematic view showing a shock test machine used in the working examples and comparative examples as described below.
Figure 13:
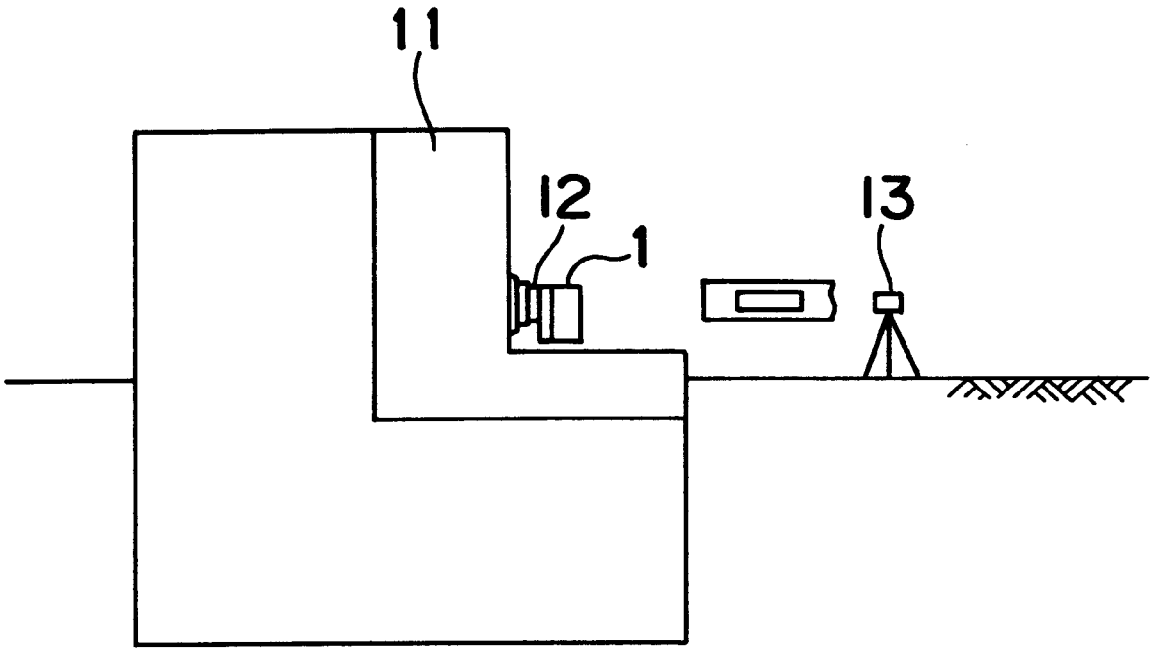
FIG. 13 is an enlarged schematic view showing the shock absorber arranged in such a manner as illustrated in FIG. 12.

A test machine as shown in FIG. 12 was used. The impact cart 10 weighing about 7 tons was allowed to run on the inclined rail 9 and to collide at the speed of 1.8 m/sec with the shock absorber 1 fixed with the load cell 12 on the collision side of the rigid block 11 as shown in FIG. 13. The shock-absorbing performance of the shock absorber 1 was evaluated by the laser displacement gauge. The reference numeral 13 indicates an accelerometer.

Impact-Receiving Area

This is defined as the contact area between the impact cart and the shock absorber. For the shock absorber of the first type, it represents the apparent contact area as a formed part, not the real contact area on only cell walls of the formed part.

Plateau Strength

This is determined by dividing the maximum value of reaction at the plateau portion after the initial rise in the load (reaction) vs. compressibility curve as shown in FIG. 8 by the shock-receiving area of the shock absorber.

Absorption of Compression Energy per Unit Volume

The energy absorption per unit volume of the shock absorber was determined at the point of critical compression on the load (reaction) vs. compressibility curve where displacement reached about 0.2 mm/tf.

Maximum Reaction

In the above collisional compression test, the maximum reaction generated by the collision between the impact cart and the shock absorber was determined.

Maximum Displacement by Compression

In the above collisional compression test, the maximum displacement by compression observed in the collision between the impact cart and the shock absorber was determined.

Impact on Rigid Block

In the above collisional compression test, the power of destroying the rigid block was estimated at 25 tf for the impact-receiving area of the shock absorber being 500 mm×100 mm. When the above maximum reaction was over 25 tf, an impact was considered to be loaded on the rigid block.

Energy Absorption

The energy absorption or the amount of energy absorbed in the shock absorber was defined as the difference of kinetic energy calculated from the speeds of the impact cart before and after the collision.

Example 1

A shock absorber with a honeycomb structure as shown in FIG. 1 was prepared by injection molding with polyester elastomer "PELPRENE® P-90B" available from Toyobo. The wall thickness and length of one side of each hexagonal cell in the honeycomb structure were 4.3 mm and 25 mm, respectively. The total width, depth, and height of the shock absorber were 500 mm, 100 mm, and 100 mm, respectively. The performance test of the shock absorber was performed at 15° C. The results are shown, together with the physical properties of the material, in Table 1.

Example 2

A shock absorber with a honeycomb structure in the same shape and size as described in Example 1 was prepared by injection molding with polyester elastomer "PELPRENE® P-150B" available from Toyobo. The performance test of the shock absorber was performed at 40° C. The results are shown, together with the physical properties of the material, in Table 1.

Example 3

A shock absorber with a honeycomb structure as shown in FIG. 1 was prepared from aluminum. The wall thickness and length of one side of each hexagonal cell in the honeycomb structure were 0.07 mm and 5.5 mm, respectively. The total width, depth, and height of the shock absorber were 500 mm, 300 mm, and 100 mm, respectively. The performance test of the shock absorber was performed at 15° C. The results are shown, together with the physical properties of the material, in Table 1.

Example 4

A shock absorber with a honeycomb structure as shown in FIG. 1 was prepared by injection molding with nylon "T-22" available from Toyobo. The wall thickness and length of one side of each hexagonal cell in the honeycomb structure were 4.3 mm and 25 mm, respectively. The total width, depth, and height of the shock absorber were 500 mm, 30 mm, and 100 mm, respectively. The performance test of the shock absorber was performed at 40° C. The results are shown, together with the physical properties of the material, in Table 1.

Comparative Example 1

A commercially available chloroprene rubber plate of hardness 63A, widely used as a cushioning material, was cut into a solid bar as a shock absorber. The total width, depth, and height of the shock absorber were 500 mm, 100 mm, and 100 mm, respectively. The performance test of the shock absorber was performed at 15° C. The results are shown in Table 1.

TABLE 1

| | Example 1 | Example 2 | Example 3 | Example 4 | Comparative Example 1 |
|---|---|---|---|---|---|
| Shock absorber Material | polyester elastomer P90B | polyester elastomer P150B | aluminum | nylon T222 | chloroprene rubber (hardness 63A) |
| Width (mm) | 500 | 500 | 500 | 500 | 500 |
| Depth (mm) | 100 | 100 | 300 | 30 | 100 |
| Height (mm) | 100 | 100 | 100 | 100 | 100 |
| Test temperature (° C.) | 15 | 40 | 15 | 40 | 15 |
| Impact-receiving area ($m^2$) | 0.05 | 0.05 | 0.15 | 0.02 | 0.05 |
| Weight of formed part (kg) | 3 | 3 | 0.6 | 2 | 7.5 |

TABLE 1-continued

| | Example 1 | Example 2 | Example 3 | Example 4 | Comparative Example 1 |
|---|---|---|---|---|---|
| Elastic modulus in flexure of resin (kgf/cm$^2$) | 1650 | 2950 | 270,000 | 8600 | — |
| Plateau strength (tf/m$^2$) | 240 | 400 | 130 | 1100 | — |
| Absorption of compression energy per unit volume (tf.m/m$^3$) | 282 | 267 | 160 | 750 | 121 |
| Maximum reaction (tf) | 21.3 | 24 | 28 | 30 | 79.4 |
| Maximum displacement by compression (mm) | 72.4 | 61.8 | 80 | 65 | 66.6 |
| Energy absorption (tf.m) | $1.04 \times 10^5$ | $1.04 \times 10^5$ | $1.04 \times 10^5$ | $1.04 \times 10^5$ | $9.45 \times 10^4$ |
| Impact on rigid block | none | none | none | none | loaded |

Example 5

Figure 7:
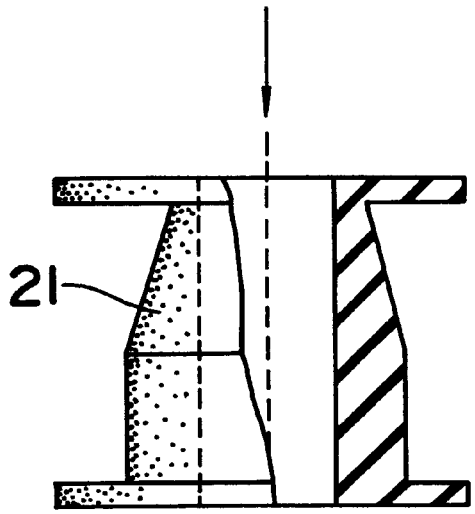
FIG. 7 is a partly sectional side view showing a specific example of the shock absorber of the second type, which can be used in the bridge of shock-absorbing construction according to the present invention.

A shock absorber with a double-flanged type cylindrical structure in the shape and size as shown in FIG. 7 and in Table 2, respectively, was prepared by injection molding with polyester elastomer "PELPRENE®P-55B" available from Toyobo. The performance test of the shock absorber was performed at 15° C. The results are shown, together with the physical properties of the material, in Table 2.

Example 6

A shock absorber with a double-flanged type cylindrical structure in the shape and size as shown in FIG. 7 and in Table 2, respectively, was prepared by injection molding with nylon "T222" available from Toyobo. The performance test of the shock absorber was performed at 40° C. The results are shown, together with the physical properties of the material, in Table 2.

Comparative Example 2

A commercially available chloroprene rubber block of hardness 45A was cut into a shock absorber with a double-flanged type cylindrical structure in the same shape and size as described in Example 3. The performance test of the shock absorber was conducted at 15° C. The results are shown in Table 2.

Comparative Example 3

A commercially available chloroprene rubber block of hardness 63A was cut into a shock absorber with a double-flanged type cylindrical structure in the same shape and size as described in Example 3. The performance test of the shock absorber was conducted at 15° C. The results are shown in Table 2.

TABLE 2

| | Example 5 | Example 6 | Comparative Example 2 | Comparative Example 3 |
|---|---|---|---|---|
| Shock absorber | polyester | nylon | chloroprene | chloroprene |
| Material | elastomer P55B | T222 | rubber (hardness 45A) | rubber (hardness 63A) |
| Outer diameter (mm) | 80 | 80 | 80 | 80 |
| Inner diameter (mm) | 40 | 70 | 40 | 40 |
| Height (mm) | 100 | 100 | 100 | 100 |
| Test temperature (° C.) | 15 | 40 | 15 | 15 |
| Weight of formed part (kg) | 0.5 | 0.2 | 0.6 | 0.8 |

TABLE 2-continued

| | Example 5 | Example 6 | Comparative Example 2 | Comparative Example 3 |
|---|---|---|---|---|
| Elastic modulus in flexure of resin (kgf/cm$^2$) | 770 | 8600 | — | — |
| Plateau strength (tf/m$^2$) | 2000 | 2000 | — | — |
| Absorption of compression energy per unit volume (tf.m/m$^3$) | 478 | 500 | 140 | 180 |
| Maximum reaction (tf) | 11.5 | 12 | 31.9 | 24.4 |
| Maximum displacement by compression (mm) | 63 | 60 | 86 | 83 |
| Energy absorption (tf.m) | $2.70 \times 10^4$ | $2.70 \times 10^4$ | $3.20 \times 10^4$ | $3.10 \times 10^4$ |
| Impact on rigid block | none | none | loaded | loaded |

As can be seen from Tables 1 and 2, the shock absorbers of Examples 1 to 6 exhibited excellent shock-absorbing performance, so that shock-absorbing construction with any of the shock absorbers can effectively absorb or attenuate the shock of collisions, by earthquakes or other factors, between the horizontal members or between the horizontal member and the vertical member, and the shock on the points of their connection through connectors. Therefore, the bridge of such shock-absorbing construction can prevent, with high reliability, the breakage or separation of horizontal members or vertical members, and the breakage of neighboring structures caused by these shocks, and can therefore sufficiently withstand to earthquakes or other factors. If the shock absorbers are formed from a material with excellent rust resistance, water resistance, and weatherability, the bridge containing such shock absorbers can find various applications, including inland bridges, coastal bridges, and marine connecting bridges, even in which case the bridge is free of maintenance to retain excellent shock-absorbing performance for a long period of time.

What is claimed is:

1. A bridge of shock-absorbing construction, comprising:

a plurality of horizontal members arranged in series adjacent to one another;

a plurality of vertical members with bearing means for supporting the plurality of horizontal members; and a plurality of shock absorbers disposed at the points of possible contact between at least one of the plurality of horizontal members, one of the plurality of horizontal members, and one of the plurality of vertical members, wherein each of the plurality of shock absorbers is formed from a material with an elastic modulus in flexure over 200 kgf/cm$^2$ and has a cell structure with a plurality of cells separated by wall elements having a length and a width, where the length is substantially greater than the width, and wherein the plurality of shock absorbers are arranged such that they do not regularly bear a load of the plurality of horizontal members, but they experience intentional buckling deformation or permanent deformation of the wall elements by compression when loaded substantially parallel to the lengthwise direction of the wall elements with a shock generated by substantially horizontal movement of the plurality of horizontal members during a seismic event, thereby attaining effective shock absorption, and each of the plurality of shock absorbers has a plateau strength of 50 tf/m$^2$ or higher in the lengthwise direction of the wall elements.

2. The bridge according to claim 1, wherein each of the plurality of shock absorbers absorbs compression energy of 50 tf.m/m$^3$ or higher when compressed in the lengthwise direction of the wall elements.

3. The bridge according to claim 1, wherein each of the plurality of shock absorbers is formed from a resin with an elastic modulus in flexure ranging from 500 to 20,000 kgf/cm$^2$.

4. The bridge according to claim 1, wherein each of the plurality of shock absorbers is formed from a material with an elastic modulus in flexure over 5000 kgf/cm$^2$.

5. The bridge according to claim 1, wherein at least one of the plurality of shock absorbers has the wall elements provided with a particular portion that first experiences intentional deformation when loaded with the shock.

6. The bridge according to claim 5, wherein at least one of the plurality of shock absorbers has the wall elements with a cutout portion that first experiences intentional deformation when loaded with the shock.

7. The bridge according to claim 5, wherein at least one of the plurality of shock absorbers has the wall elements with a stepped portion that first experiences intentional deformation when loaded with the shock.

8. The bridge according to claim 5, wherein at least one of the plurality of shock absorbers has the wall elements with a thin-walled portion that first experiences intentional deformation when loaded with the shock.

9. The bridge according to claim 5, wherein the cell structure of at least one of the plurality of shock absorbers has a hexagonal or lower polygonal pattern in a section perpendicular to the lengthwise direction of the wall elements.

10. The bridge according to claim 9, wherein the cell structure of at least one of the plurality of shock absorbers is a honeycomb structure with a hexagonal pattern in a section perpendicular to the lengthwise direction of the wall elements.

11. A bridge of shock-absorbing construction, comprising:

a plurality of horizontal members arranged in series adjacent to one another;

a plurality of vertical members with bearing means for supporting the plurality of horizontal members;

a plurality of connectors for connecting at least one of the plurality of adjacent horizontal members, one of the plurality of horizontal members, and one of the plurality of vertical members; and a plurality of shock absorbers disposed at the ends of the plurality of connectors such that at least one of the plurality of connectors runs through a corresponding at least one of the plurality of shock absorbers, wherein each of the plurality of shock absorbers is formed from a material with an elastic modulus in flexure over 200 kgf/cm$^2$ and has a columnar structure with a column body having an axial hollow portion for passing the corresponding one of the plurality of connectors therethrough, and wherein the plurality of shock absorbers are arranged such that they do not regularly bear a load of the plurality of horizontal members, but they experience intentional buckling deformation or permanent deformation of the column body by compression when loaded substantially parallel to the axial direction of the hollow portion with a shock generated by substantially horizontal movement of the plurality of horizontal members during a seismic event, thereby attaining effective shock absorption, and each of the plurality of shock absorbers has a plateau strength of 50 tf/m$^2$ or higher in the axial direction of the hollow portion.

12. The bridge according to claim 11, wherein each of the plurality of shock absorbers has a plateau strength of 400 tf/m$^2$ or higher and absorbs compression energy of 200 tfm/m$^3$ or higher when compressed in the axial direction of the hollow portion.

13. The bridge according to claim 11, wherein each of the plurality of shock absorbers is formed from a resin with an elastic modulus in flexure ranging from 200 to 5000 kgf/cm$^2$.

14. The bridge according to claim 11, wherein each of the plurality of shock absorbers is formed from a material with an elastic modulus in flexure over 5000 kgf/cm$^2$.

15. The bridge according to claim 11, wherein at least one of the plurality of shock absorbers has a flange.

16. The bridge according to claim 11, wherein at least one of the plurality of shock absorbers has the column body with a particular portion that first experiences intentional deformation when loaded with the shock.

17. The bridge according to claim 16, wherein at least one of the plurality of shock absorbers has the column body with a cutout portion that first experiences intentional deformation when loaded with the shock.

18. The bridge according to claim 16, wherein at least one of the plurality of shock absorbers has the column body with a thin-walled portion that first experiences intentional deformation when loaded with the shock.

19. The bridge according to claim 16, wherein at least one of the plurality of shock absorbers has the column body with an accordion portion that first experiences intentional deformation when loaded with the shock.

20. The bridge according to claim 11, wherein at least one of the plurality of connectors is a connection cable.

* * * * *